United States Patent [19]

Kubo et al.

[11] 4,088,803

[45] May 9, 1978

[54] ELECTRICAL CONTACT AND PROCESS OF MANUFACTURE

[75] Inventors: Masatoshi Kubo, Tokyo; Toshito Hara, Sagamihara; Yuji Hayashi, Susaka; Makoto Kassai, Yokohama; Norio Matsumoto, Kawasaki; Tsuneyoshi Nishi, Yokohama; Koushichi Suzuki; Michiko Kodama, both of Yokohama; Kaduwo Sintani, Tokyo, all of Japan

[73] Assignee: Fujitsu Limited, Kanagawa, Japan

[21] Appl. No.: 613,438

[22] Filed: Sep. 15, 1975

[30] Foreign Application Priority Data

| | | |
|---|---|---|
| Dec. 27, 1974 | Japan | 49-3731 |
| Sep. 19, 1974 | Japan | 49-107129 |
| Feb. 7, 1975 | Japan | 50-15450 |

[51] Int. Cl.[2] ..... C25D 5/50; H01H 1/02

[52] U.S. Cl. ..... 427/123; 427/89; 427/124; 427/125; 427/376 H; 427/383 C; 427/383 D; 427/405; 427/406; 204/37 R; 204/37 T; 204/38 B; 200/268

[58] Field of Search ..... 427/89, 123, 125, 124, 427/406, 405, 383 C, 383 D, 376 H; 200/268; 204/46 R, 37 R, 45.5, 37 T, 38 B

[56] References Cited

U.S. PATENT DOCUMENTS

| | | | |
|---|---|---|---|
| 3,369,159 | 2/1968 | Shiuonen | 427/125 |
| 3,663,777 | 5/1972 | Steinmetz | 200/268 |
| 3,671,314 | 6/1972 | Gackstetter | 427/125 |
| 3,889,098 | 6/1975 | Steinmetz | 200/268 |

FOREIGN PATENT DOCUMENTS

| | | | |
|---|---|---|---|
| 2,151,008 | 4/1973 | France | 427/89 |

*Primary Examiner*—Michael F. Esposito
*Attorney, Agent, or Firm*—Staas & Halsey

[57] ABSTRACT

Electrical contacts are produced by processes comprising (1) forming on a metallic body a first layer of low melting metal(s) and (2) forming on the first layer a second layer of high melting metal(s). The thus produced contacts possess prolonged life, approximately 10 times that of conventional contacts when they are operated as working contact.

20 Claims, 7 Drawing Figures

A
B
C
D
E
F
G
H
(%)
100
50.0
5.0
1.0
CUMULATIVE FAILURE RATE
$10^5$
$10^6$
$10^7$
NUMBER OF OPERATIONS

ELECTRICAL CONTACT AND PROCESS OF MANUFACTURE

BACKGROUND OF THE INVENTION

1. Field of the Invention

The present invention relates to electrical contact referred to as working contacts, and to a process of manufacture thereof.

The working contact is used, for example, in a relay of an electric circuit and interrupts the flow of the electric current passing through the circuit at the breaking opeation. The electric discharge, which takes place at the making and breaking operations, brings about one important phenomenon of the working contact, i.e. the erosion of the contact. The erosion of the contact principally results from the transfer of the cotact material. The transfer of material means a movement of metallic material such that a metal of one contact member gradually moves to the opposite contact member across the contacting surfaces thereof, as the contact repeats the making and breaking operations. The transfer of material results from:

(1) a short arc generated immediately before connecting and after disconnecting the contacts.

(2) melting of the material due to the Joule heat caused by the electric current passage across the contacting portions of the contact and depending upon the contact resistance of said portions, and;

(3) a bridge formation when the contact initiates the breaking.

When the contact begins to be subjected to erosion, metal of one of the electrodes, i.e. contact members, transfers to the other electrode with the result that the transferred metal concentrates, i.e., collects on said other electrode. Pips and craters are, accordingly, formed on, for example, the cathode and anode contacts, respectively. As the pips and craters grow, the separation of the contact becomes degraded and it finally loses its function as a contact. In this state, the contact fails and its usefulness as a contact is terminated.

As stated above, erosion of the electrical contact is critical to the life thereof and, thus, it is important to avoid such erosion. It is generally recognized that erosion of the contact depends upon circuit conditions, such as the voltage, current density and load and, further, that erosion of the contact is lowered with decreased levels of the above circuit conditions. The kinds of materials used for the contact of a particular circuit have a large influence on the erosion of the contact. The materials to be used for the contact are, therefore, critical to the life of the contact members and, thus, various kinds of material for the electrical contact have been proposed.

Several noble metals having high melting temperatures are widely used as the electric contact members such as gold for the gold diffusion contact and the hard gold contact, rhodium, rhenium and rutenium. The known contacts, however, are not suited for working contacts operated at a medium level of circuit conditions.

There is provided in the British Patent Specification No. 1,048,520, a method for the manufacture of composite contact assembly consisting of a core and a sheath, wherein the core is made of either of copper, copper alloy, steel, nickel, or aluminum, and the sheath is constituted of brazing material selected from silver solders, tin and tin-lead solders. However, this composite contact is, also, not suited for the working contact described above.

SUMMARY OF THE INVENTION

It is, therefore the object of the present invention to provide a working contact, which can be operated over a long period of time at medium level conditions without excessive erosion of the contact members.

According to said object of the present invention, there is provided an electric contact produced by the process which comprises the steps of:

forming on a metallic body a first metallic layer consisting of at least one low melting metal having a melting temperature lower than 500° C, and;

forming on said first metallic layer a second metallic layer consisting of at least one high melting metal having a melting temperature higher than 1500° C. The metallic body can consist of known, soft magnetic- or semi hard magneticalloy, such as for use when the contact members are to be operated under magnetic force.

The typical low melting metals and high melting metals are shown in Tables I and II, respectively. The boiling temperatures of the low melting metals are relatively high.

Table I

| Metal | Melting Point (° C) | Boiling Point (° C) |
|---|---|---|
| Tin (Sn) | 231 | 2270 |
| Lead (Pb) | 327 | 1620 |
| Indium (In) | 156 | 2100 |
| Cadmium (Cd) | 320 | 767 |
| Zinc (Zn) | 419 | 907 |

Table II

| Metal | Melting Point (° C) | Boiling Point (° C) |
|---|---|---|
| Rhodium (Rh) | 1966 | 3960 |
| Rhenium (Re) | 3147 | 5900 |
| Ruthenium (Ru) | 2500 | 3700 |
| Iridium (Ir) | 2450 | 4800 |
| Tungsten (W) | 3370 | 5700 |
| Molybdenum (Mo) | 2620 | 4600 |

It is preferable that the low melting metal is at least one member selected from the group consisting of tin and iridium and further, the high melting metal is at least one member selected from the group consisting of rhodium and rhenium.

The method for formation of the first metallic layer can be any surface treatment technique including electrolytic plating, dry plating such as sputtering, ion plating and evaporation, which provide a non-porous layer. With regard to the electrolytic plating, the plating conditions are known, and the typical conditions for electrolytic plating are as illustrated in Table III below.

Table III

| Metal | Composition of Electrolyte | | Current Density ($A/dm^2$) | Time Period (for 1 micron of layer) |
|---|---|---|---|---|
| Tin (Sn) | $SnSO_4$ | 60g/l | 2 | 1 min |
| | $H_2SO_4$ | 100 | | |
| | UTBA | 10 | | |
| | Jelatin | 2 | | |
| Lead (Pb) | $Pb(BF_4)_2$ | 205g/l | 2 | 40 sec. |
| | $HBF_4$ | 20 | | |
| | $H_3BO_3$ | 20 | | |
| | Jelatin | 0.15 | | |
| Indium (In) | $InCl_3$ | 60g/l | 2 | 2 min |
| | KOH | 40 | | |
| | KCN | 160 | | |
| | $C_6H_2O_6$ | 30 | | |

Table III-continued

| Metal | Composition of Electrolyte | | Current Density (A/dm²) | Time Period (for 1 micron of layer) |
|---|---|---|---|---|
| Cadmium (Cd) | $Cd(CN)_2$ | 45g/l | 2 | 2 min 30 sec. |
| | NaCN | 49 | | |
| | NaOH | 20 | | |
| Zinc (Zn) | $Zn(CN)_2$ | 60g/l | 2 | 2min |
| | NaCN | 40 | | |
| | NaOH | 80 | | |

The method for formation of the second metallic layer is usually electrolytic plating, when said high melting metal is at least one of rhodium, rhenium and ruthenium.

The electrodes of the contact are subjected to Joule heat as a result of the time of making and breaking operations and, thereby, softened. The contact according to the present invention contains on its surface the high melting metal(s) which can maintain the mechanical strength required for stable operation. The Joule heat applied to the contact members during operation will provide the thermal condition, at which the low melting metal(s) of the underlying layer is considerably softened.

The underlying layer greatly contributes to lengthening life of the contact. Namely, when the pips are formed on one of the electrodes due to transfer of material, the pips are compressed, by the mechanical impact of the contacts' operation, to the level of the electrode, because these electrodes are comprised of an underlying layer having a hardness inferior to that of the high melting metal(s), as a result of which it is deformed so as to flatten the surface of the electrode. Consequently, the pips cannot grow to such an extent that the separation of the contact members becomes degraded and, therefore, the life of the contact is prolonged. The Joule heat also provides a condition, in which diffusion betwen the high-and low melting metals takes place, and, as a result of said diffusion, an alloy or intermetallic compounds is formed. The alloy or intermetallic compounds also improve life of the contact, because these have a hardness less than those of the high melting metals and, as a result, the pips due to transfer of material can be compressed into a region containing a higher amount of the alloy or intermetallic compounds.

It is possible to form the alloy or the intermetallic compounds prior to using the contact. For this purposes, there are provided several electric contacts produced by processes which include a step of bringing the metals into contact with each other at a temperature where diffusion between the metals occurs, desirably at a temperature above the melting point but below the boiling point of the low melting metals(s).

One of the preferable processes is based on a dry coating method and comprises the steps of: firstly forming on a metallic body a first layer of the low melting metal(s), and; secondly, dry-coating on the so-formed layer a second layer of the high melting metal(s). The first step can be carried out by any known method, such as vapor deposition and plating, etc. The dry coating employed in the second step is a collective name encompassing all of a sputtering method, wherein, for example, argon strikes against a target of a metal so that this metal is deposited on a metallic body, an ion plating method, wherein ionized elements are accelerated and strike against the substrate so that the coating of the elements is formed, and a vacuum evaporation method. While the dry coating is being effected, the temperature of the atmosphere in the vessel where the dry coating proceeds rises to approximately 100° C so that a sufficient condition exists to form alloy or intermetallic compounds between the metals of high- and low-melting temperatures. In a case where the low melting metal is indium the temperature in the vessel is adequate to form the desired amounts of the alloy or intermetallic compounds. On the other hand, if the low melting metal is tin, lead, cadmium or zinc, it would be advisable to additionally heat the low melting metal so as to produce an increased amount of the alloy or intermetallic compounds, since it is known said amount depends upon the temperature at which both metals diffuse. It would, therefore, be preferable that the first metallic layer be heated to a temperature close to the melting point of the low melting metal(s) and simultaneously form the second metallic layer. The heating of the first metallic layer can be carried out by any known method, for example, placing the metallic body on a plate accommodating a resistance heating means.

The second preferable process is based on electrolytic plating and comprises the steps of: firstly, forming on a metallic body the first metallic layer of the low melting metal(s); secondly, plating on the first layer the second layer of the high melting metal(s), and; finally, heating said two layers to a temperature exceeding the melting point but below the boiling point of said low melting metal(s). The plating conditions are known, and the typical conditions for electrolytic plating are as illustrated in Table IV below.

Table IV

| Metal | Composition of Electrolyte | Current Density (A/dm²) | Time Period (for 1 micron of layer) |
|---|---|---|---|
| Rhodium | RHODEX (TRADE MARK) containing $(Rh)_3(SO_4)_2$ and $H_2SO_4$ the principal components | 1.3 | 6 min. 40 sec. |
| Rhenium | $KReO_4$ 1.5g/l<br>$H_2SO_4$ 12 – 15g/l | 15 | 5 min. |
| Ruthenium | (RUTHENEX (TRADE MARK) containing $RuCl_3$ and HC1 as the principal components. | 1 | 10 min. |

In order to effect firm bonding between the metallic body and the first plated layer, as well as between the first and second, plated layers, it would be advisable to form an intermediate plating layer, for example in a gold, electrolytic bath.

The working contacts according to the present invention are particularly suited for operation at a current of from 0.0996 to 0.104 amperes and voltage of from 48 to 52 volts.

BRIEF DESCRIPTION OF THE DRAWINGS

The present invention is explained in detail by way of Examples in connection with drawings, wherein.

DETAILED DESCRIPTION OF THE INVENTION

EXAMPLE 1

Figure 1:
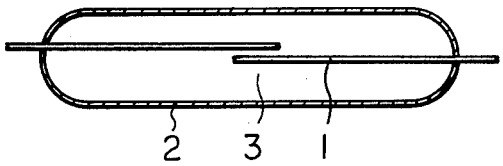
FIG. 1 represents the cross sectional view of a reed switch.

The Inventors intended in this Example to produce reed switches composed of a glass capsule 2 and reed blades 1 (FIG. 1) and to test the contact life thereof under working conditions. The contact members according to the present invention were employed as the reed blades 1.

Three types of contacts were formed on a working portion 3 of each blade 1 (FIG. 2) as follows: tin layer 6 and rhodium layer 7; indium layer 6 and rhodium layer 7, and; tin layer 6 and rhenium layer 7. The metallic body 4 consisted of the ferromagnetic 52-alloy, i.e. an alloy of 48% iron and 52% nickel.

The metallic body 4 had at the paddle portion (i.e., the working portion 3) thereof dimensions of 10 mm length, 1.89 mm width and 0.24 mm thickness. The layers 6 and 7 had a thickness of one micron. All of the layers were formed by electrolytic plating under the conditions shown in Table V below.

Table V

| Layer | Composition of Electrolyte | Current Density ($A/dm^2$) | Time | Temperature (° C) |
|---|---|---|---|---|
| Gold Layer 5 | AUROBOND (TRADE MARK) containing $Kau(CN)_2$ as the principal ingredient. | 10 | 20 sec. | 25 |
| Tin Layer 6 | $SnSO_4$ 60 g/l<br>UTBA 10<br>$H_2SO_4$ 100<br>Jelatin 2 | 2 | 1 | 25 |
| Rhodium Layer 7 | RHODEX (TRADE MARK) | 1.3 | 6 min. 40 sec. | 45 |
| Indium Layer 6 | $InCl_3$ 60 g/l<br>KCN 160<br>KOH 40<br>$C_6H_2O_6$ 30 | 2 | 2 min | 20 |
| Rhodium Layer 7 | PHODEX (TRADE MARK) | 1.3 | 6 min 40 sec. | 45 |
| Tin Layer 6 | $SnSO_4$ 60g/l<br>UTBA 10<br>$H_2SO_4$ 100<br>Jelatin 2 | 2 | 1 min | 25 |
| Rhenium Layer 7 | $KReO_4$ 15g/l<br>$H_2SO_4$ 12 - 15 | 15 | 5 min | 85 |

For comparison purposes, reed switches were manufactured utilizing known contacts, e.g., the hard gold contact, the gold diffusion contact, the rhodium contact, the rhodium diffusion contact, and the plated tin contact in a manner such that each layer was formed of 2 micron thickness on the same type metallic body as used for the reed switch for the present invention.

Figure 3:
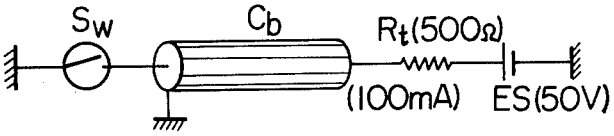
FIG. 3 represents the electrical circuit used for testing the contact.
Figure 4:
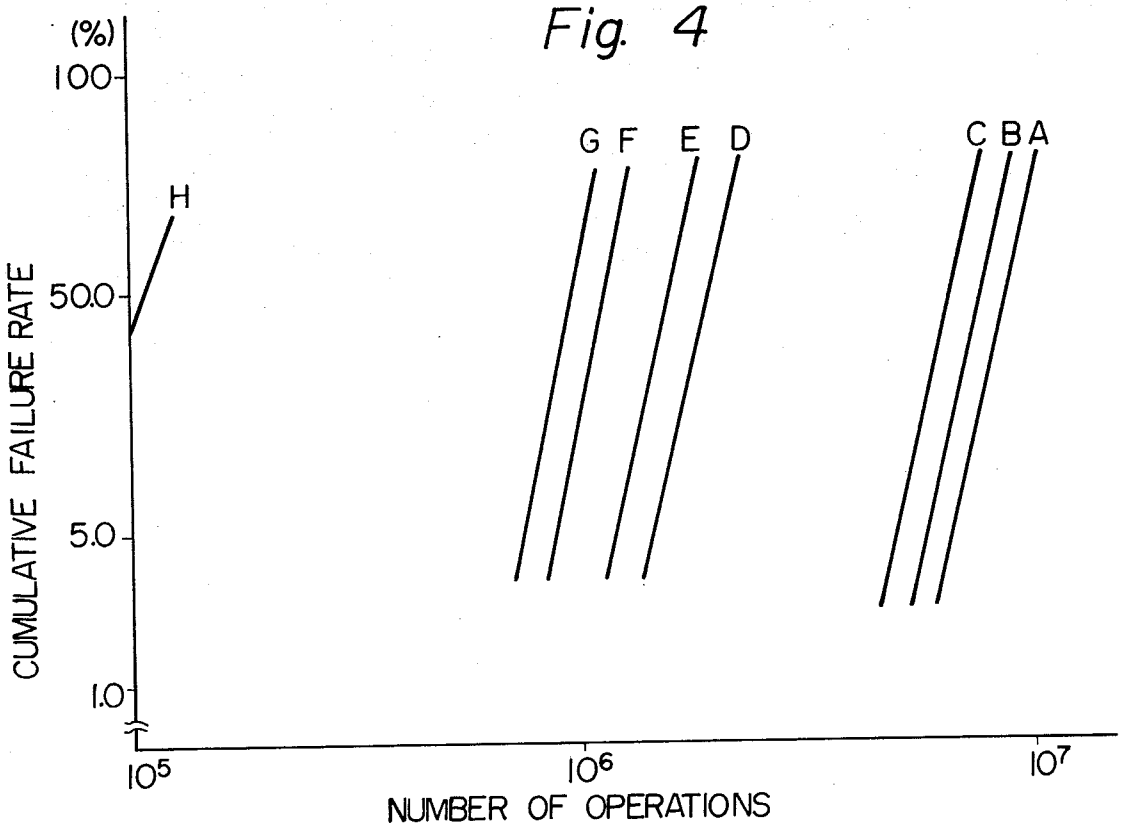
FIG. 4 represents a graph illustrating the relationship between the cumulative failure rate in % taken in the ordinate and the number of operations taken in the abscissa.

Every reed switch so manufactured was connected as a relay in an exchange circuit as illustrated in FIG. 3, wherein the reference letters Es, Rt, Cb and Sw designate an electric potential source, a resistance of 500Ω, a cable and said reed switch, respectively. 100 milliamperes of electric current was passed through the circuit and 50 volts was applied thereto from source Es. In order to determine the life of the contact a number of reed switches were tested and the making and breaking operations of the reed switches were continued until the reed switches failed. The relationship between the number of operations and the cumulative failure rate in percentage is seen in FIG. 4, wherein the references A, B, and C, designate the contacts of the present invention of tin-rhodium, indium-rhodium, and tin-rhenium, respectively; and the other references designate the conventional contacts as follows: D- the hard gold contact, E- the gold diffusion contact, F- the rhodium contact, G- the rhodium diffusion contact, and H- the plated tin contact.

As is apparent from FIG. 4, the contacts according to the present invention A, B and C achieved contact life of approximately ten times longer than those of the conventional contacts D through H.

Among the conventional contacts, the plated tin contact H failed at a low order of $10^5$ times of operation. The contact F has a layer of low melting metal (Sn) at the surface thereof so that the metal is melted by the Joule heat, thereby causing fusion bonding between each member of the contact. As a result of the fusion bonding the contact becomes unable to separate. The reason the conventional contacts D through G have life of the contact inferior to that of the contacts A, B and C does not reside in the fusion bonding but in the fact that the growing pips, due to transfer of material, make it difficult for the contact members to separate.

On the other hand, with regard to contacts A, B and C, the tin or indium layer 6, which has a hardness below the rhodium layer 7, during the operation is deformed by mechanical impact so that the growth of pips is prevented. In addition, the Joule heat applied to the contacts produces a condition in which alloy or intermetallic compounds are formed between the first and second layers. The contact members including the alloy or intermetallic compounds are subjected to mechanical impact, and the alloy or intermetallic compounds are more easily deformed than the high melting metals, i.e. rhodium and rhenium, thereby preventing the growth of the pips to the extent that the separation of the contact members becomes degraded.

It will be apparent to a person skilled in the art that better results can be obtained when reed switches are used in a circuit without a cable.

EXAMPLE 2

Figure 2:
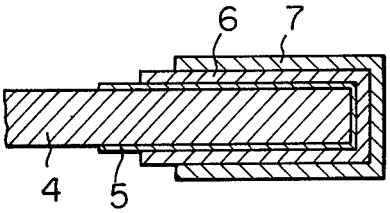
FIG. 2 represents the cross sectional view of a contact member produced in an Example of the present invention.

In this Example contacts were produced by processes based on dry coating. The reed switches manufactured consisted of components as shown in FIGS. 1 and 2.

The tin layer 6 having a thickness of 25 micron was formed on the gold plated layer 5 by a method similar to that of Example 1. The metallic body 4, on which the tin layer 6 has been formed, was faced with a target of rhodium within a chamber of sputtering equipment. The argon gas contained in the chamber was sputtered against the target so as to form a rhodium layer 7 ofone micron in tickness on the tin layer 6, thereby obtaining a contact, hereinafter referred to as contact I.

The metallic body 4, on which the hereinabove described tin layer 6 had been formed, was heated to 200° C, which lies close to the melting point of tin (231.9° C), in the chamber of the sputtering equipment and, simultaneously, treated according to the same sputtering method as employed for obtaining the contact I. The tin layer was, therefore, heated to a temperature above its melting point. The heating temperature was selected so as to be close to the melting point of tin, 231.9° C. The formed rhodium layer had a thickness of one micron. This contact, produced by the additional heating method, is hereinafter referred to as contact J.

A number of reed switches were manufactured by employing the so produced two types of contacts I and J.

For the comparison purpose, reed switches were maufactured by employing the contact hereinafter referred to as contact K and consisting of the metallic body, and a rhodium layer of one micron directly deposited on the metallic body by employing the sputtering technique.

All of the reed switches were tested according to the same method as described in Example 1. The results are illustrated in FIG. 5 which is expressed in terms of the same abscissa and odinate as those of FIG. 4.

Figure 5:
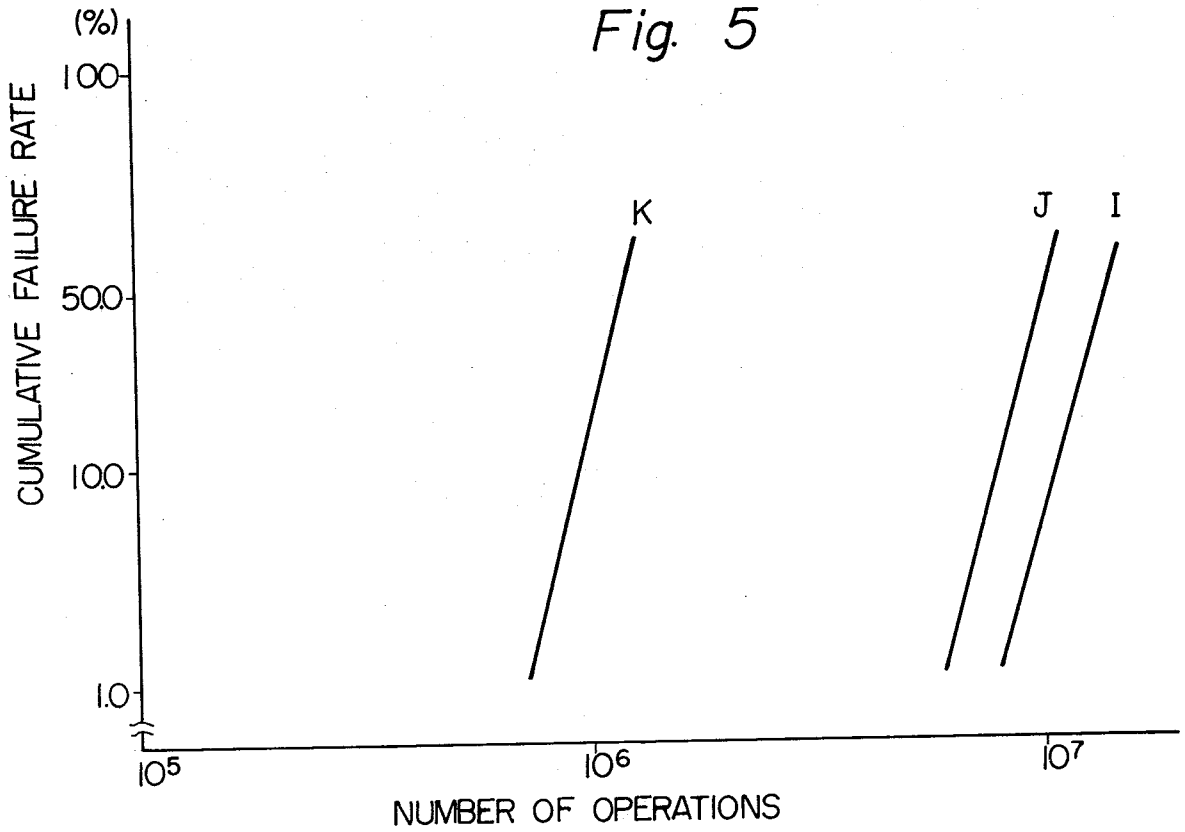
FIG. 5 represents the same graph as FIG. 4.

As is clear from the FIG. 5, the contacts of the present invention I and J exhibit life of the contact which are 10 times longer than that of the conventional contact K.

Both of the contacts I and J were subjected prior to their operations, to X-ray diffractometry in order to determine the constituents of the surface layers of the contacts. The results are shown in Table VI.

Table VI

| | Interplanar Spacing (A) | | | | | | | | |
|---|---|---|---|---|---|---|---|---|---|
| contact I | — | — | — | 2.21 | 1.90 | — | 1.35 | — | 1.15 |
| Contact J | 2.95 | 2.84 | 2.57 | 2.21 | — | 1.42 | — | 1.27 | |
| Rhodium (1) | — | — | — | 2.196 | 1.902 | — | 1.345 | — | 1.1468 |
| $\beta$-tin (1) | 2.915 | 2.793 | 2.062 | 2.017 | 1.657 | 1.484 | 1.442 | 1.304 | 1.292 |

Rhodium and $\beta$-tin (1) are diffraction-pattern data according to ASTM cards 4-0673 and 50685, respectively.

The following facts will be apparent from Table Vi. Firstly, the surface layers of both of the contacts accoding to the Invention are not made o tin. Secondly, since the diffraction patterns corresponding to the standard rhodium patterns are detected in the surface layer of Contact I, the surface layer of the Contact I essentially consists of metallic rhodium. Thirdly, it is to be noted that the diffractory patterns of the Contact J include those which are quite different from either of the patterns of rhodium or tin. Consequently, a conclusion is reached that the surface layer of Contact J comprises alloy or intermetallic compounds between rhodium and tin. One diffraction peak from the surface layer of the Contact J, i.e. 2.21 A, corresponds to one of the standard patterns of rhodium i.e. 2.196 A and, hence, this layer is believed to contain rhodium. The fact that the patterns suggesting the presence of the alloy or intermetallic compounds were not observed in Contact I is considered to be the results of low reaction temperature. Namely, the diffusion between rhodium and tin was conducted at a temperature below the melting point of tin, so that the produced amount of alloy or intermetallic compounds was not large enough to be present in an appreciable amount at the surface of contact.

EXAMPLE 3

In this Example the electric contacts were produced by the process based on electrolytic plating and diffusion heating. The reed switches manufactured consisted of components as illustrated in FIG. 1.

Figure 6:
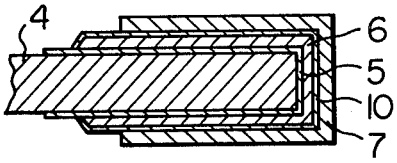
FIG. 6 represents a cross sectional view of a contact member at an intermediate plating step of a process in another Example.

Each contact member electrolytically plated in this Example consisted, as illustrated in FIG. 6, of a metallic body 4, a strike-plating gold layer 5, a tin layer 6, plating gold layer 10, which covers the tin layer 6, and a rhodium layer 7. All of the layers were formed by electrolytic plating technique under the conditions similar to those of Example 1, and the so formed contact members were heated at a temperature of from 300° to 500° C so as to effect diffusion between the tin and rhodium.

Seven kinds of contacts were produced, so that the thicknesses of the tin- and rhodium layers, material for the metallic body and the diffusion temperature were different, as shown in Table VII. The strike-plating gold layers 5 and plating gold layers 10 had thicknesses of 0.1 micron and 0.5 micron, respectively.

Table VII

| Designation of Contact | Material of the Metallic Body | Thickness of the Tin-Layer (micron) | Thickness of the Rhodium Layer (micron) | Diffusion Temperature (° C) |
|---|---|---|---|---|
| L | 52 alloy | 2 | 2 | 500 |
| M | semi-hard magnetic material | 1 | 1 | 500 |
| N | 52 alloy | 2.5 | 1.5 | 500 |
| O | 52 alloy | 2.5 | 1 | 400 |
| P | 52 alloy | 2.5 | 1.5 | 300 |
| Q | 52 alloy | 2.5 | 1 | 300 |
| R | semi-hard magnetic material | 1 | 1 | 300 |

Note:
The semi-hard magnetic material above consisted of 85% Co- 12% Fe 3% Nb-.

For the comparison purposes a known contact having only one rhodium layer of 2 micron in thickness was produced.

All of the contacts produced were tested according to the same method as used in Example 1. The results are illustrated in FIG. 7, wherein the References L through R designate the contacts as shown in Table VII and Reference S designates the known contact.

Figure 7:
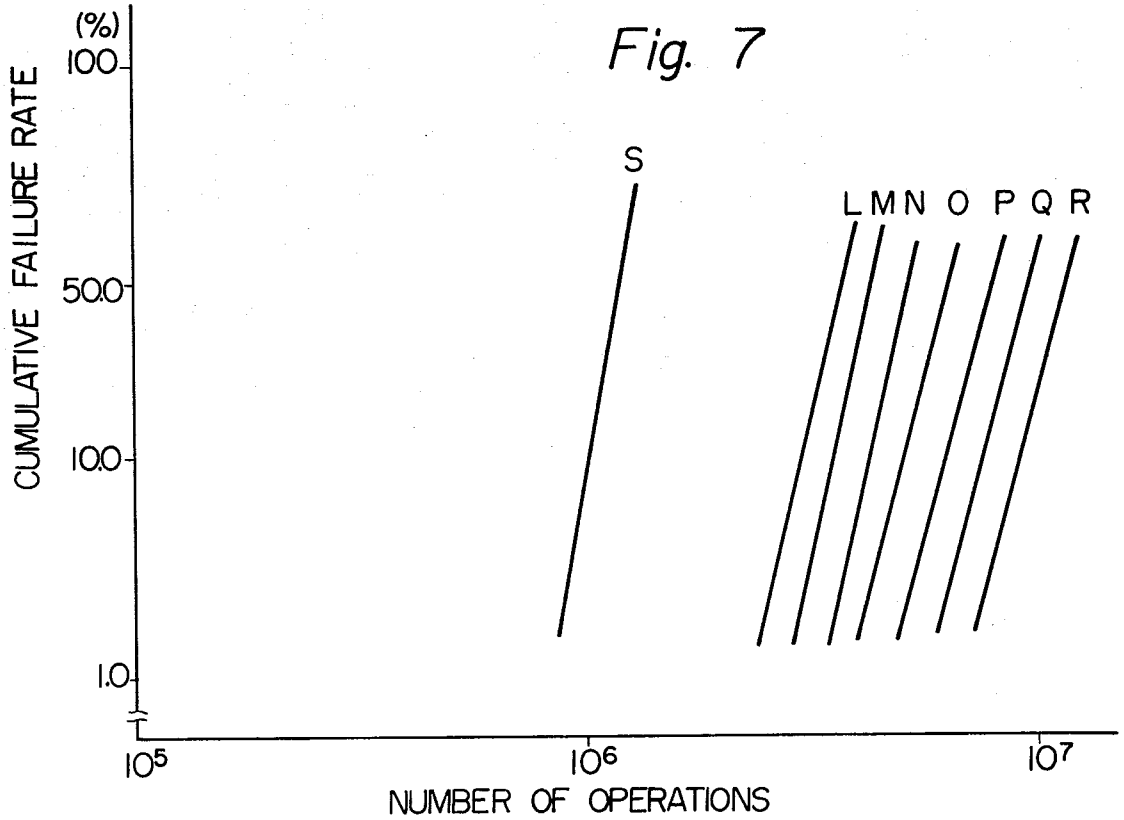
FIG. 7 represents the same graph as FIG. 4.

As is apparent from FIG. 7, the contacts of the present invention L through R exhibit life of the contact elongated from 2 to 10 times that of the known contact S. It is also apparent from FIG. 7 that the diffusion temperature of 300° C is more preferable than 500° C.

In addition, the tin and rhodium layers should preferably be from 2 to 2.5 and from 1 to 1.5 microns in thickness, respectively.

It will be apparent that many modifications and variations may be effected without departing from the scope of the novel concept of this invention. Therefore, it is intended by the appended claims to cover all such modifications and variations which fall within the true spirit and scope of the invention.

What we claim is:

1. A process for producing an electrical switch contact consisting of the steps of:

forming directly on a ferromagnetic, metallic body an inner metallic layer comprising at least one low melting temperature metal having a melting temperature lower than 500° C and being selected from the group consisting of tin, lead, indium, cadmium and zinc; and forming on said inner metallic layer a single outer non-porous metallic layer comprising at least one high melting temperature metal having a melting temperature higher than 1500° C, and being selected from the group consisting of rhodium, rhenium, ruthenium, iridium, tungsten and molybdenum.

2. A process as in claim 1 wherein said inner layer is formed to a thickness in the range of from 1–2.5 microns and said outer layer is formed to a thickness in the range of from 1–2 microns.

3. A process according to claim 1, wherein said low-melting temperature metal is tin and said high melting temperature metal is rhodium.

4. A proces as in claim 3 wherein said inner layer is formed to a thickness in the range of from 1–2.5 microns and said outer layer is formed to a thickness in the range of from 1–2 microns.

5. A process according to claim 1, wherein said low-melting temperature metal is indium and said high melting temperature is rhodium.

6. A process as in claim 5 wherein said inner layer is formed to a thickness in the range of from 1–2.5 microns and said outer layer is formed to a thickness in the range of from 1–2 microns.

7. A process according to claim 1, wherein said low melting temperature metal is tin said high melting temperature metal is rhenium.

8. A process as in claim 7 wherein said inner layer is formed to a thickness in the range of from 1–2.5 microns and said outer layer is formed to a thickness in the range of from 1–2 microns.

9. A process for producing an electrical switch contact comprising the steps of:

forming on a ferromagnetic, metallic body an inner metallic layer comprising at least one low melting temperature metal having a melting temperature lower than 500° C and being selected from the group consisting of tin, lead, indium, cadmium and zinc;

electrolytically-plating on said inner metallic layer an outer metallic layer comprising at least one high melting temperature metal having a melting temperature higher than 1500° C and selected from the group consisting of rhodium, rhenium and ruthenium, and;

heating said inner and outer metallic layers to a temperature exceeding the melting point of said low melting metal so as to produce diffusion therebetween.

10. A process as in claim 9, wherein said inner layer is formed to a thickness in the range of from 1–2.5 microns and said outer layer is formed to a thickness in the range of from 1–2 microns.

11. A process according to claim 9, wherein said low melting metal comprises at least one metal selected from the group consisting of tin and indium, and said high melting metal comprises at least one metal selected from the group consisting of rhodium and rhenium.

12. A process as in claim 11, wherein said inner layer is formed to a thickness in the range of from 1–2.5 microns and said outer layer is formed to a thickness in the range of from 1–2 microns.

13. A process for producing an electrical contact consisting of:

forming directly on a ferromagnetic, metallic body an inner metallic layer comprising at least one low melting temperature metal having a melting temperature lower than 500° C and selected from the group consisting of tin, lead, indium, cadmium and zinc, and;

dry-coating on said inner metallic layer a single outer metallic layer comprising at least one high melting temperature metal having a melting temperature higher than 1500° C, and selected from the group consisting of rhodium, rhenium, ruthenium, iridium, tungsten and molybdenum.

14. A process as in claim 13, wherein said inner layer is formed to a thickness in the range of from 1–2.5 microns and said outer layer is formed to a thickness in the range of from 1–2 microns.

15. A process according to claim 13, wherein said low melting temperature metal comprises at least one metal selected from the group consisting of indium, and said high melting temperature metal comprises at least one metal selected from the group consisting of rhodium and rhenium.

16. A process as in claim 15, wherein said inner layer is formed to a thickness in the range of from 1–2.5 microns and said outer layer is formed to a thickness in the range of from 1–2 microns.

17. A process for producing an electrical switch contact consisting of the steps of:

forming directly on a ferromagnetic, metallic body an inner metallic layer comprising at least one low melting temperature metal having a melting temperature lower than 500° C and selected from the group consisting of tin, lead, indium, cadmium and zinc;

heating said inner metallic layer to a temperature close to the melting temperature of said low melting temperature metal and simultaneously dry-coating on said inner metallic layer a single outer metallic layer comprising at least one high melting temperature metal having a melting temperature higher than 1500° C and selected from the group consisting of rhodium, rhenium, ruthenium, iridium, tungsten and molybdenum.

18. A process as in claim 17, wherein said inner layer is formed to a thickness in the range of from 1–2.5 microns and said outer layer is formed to a thickness in the range of from 1–2 microns.

19. A process according to claim 17, wherein said low melting temperature metal comprises tin and said high melting temperature comprises at least one metal selected from the group consisting of rhodium and rhenium.

20. A process as in claim 19, wherein said inner layer is formed to a thickness in the range of from 1–2.5 microns and said outer layer is formed to a thickness in the range of from 1–2 microns.

* * * * *

UNITED STATES PATENT AND TRADEMARK OFFICE

CERTIFICATE OF CORRECTION

PATENT NO. : 4,088,803
DATED : May 9, 1978
INVENTOR(S) : Kubo et al

It is certified that error appears in the above-identified patent and that said Letters Patent are hereby corrected as shown below:

Column 1, line 13, "opeation" should be -- operation --;

Column 1, line 17, "cotact" should be -- contact --;

Column 1, line 58, "rutenium" should be -- ruthenium --;

Column 2, line 19, "magneticalloy" should be -- magnetic-alloy --;

Column 3, line 52, "metals(s) should be -- metal(s) --;

Column 4, line 39, delete "(" before -- ruthenex --;

Column 6, line 54, "ofone" should be -- of one --;

Column 6, line 55, "tickness" should be -- thickness --;

Column 6, line 57, delete "The" and substitute -- In a further process utilizing an additional heating step --;

UNITED STATES PATENT AND TRADEMARK OFFICE

CERTIFICATE OF CORRECTION

PATENT NO. : 4,088,803
DATED : May 9, 1978
INVENTOR(S) : Kubo et al

It is certified that error appears in the above-identified patent and that said Letters Patent are hereby corrected as shown below:

Column 7, line 32, "Vi" should be -- VI --;

Column 7, line 33, "accod-" should be -- accord- --;

Column 7, line 34, "o" should be -- of --;

[30] Foreign Application Priority Data, "49-3731" should be -- 50-3731 --.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*